US005882454A

United States Patent [19]

Baginski et al.

[11] Patent Number: 5,882,454

[45] Date of Patent: Mar. 16, 1999

[54] PROCESS FOR MANUFACTURING A VENTING CAP

[75] Inventors: Richard Mark Baginski, Overijse; Neil John Rogers, Brussel, both of Belgium

[73] Assignee: The Procter & Gamble Company, Cincinnati, Ohio

[21] Appl. No.: 817,470

[22] PCT Filed: Oct. 13, 1995

[86] PCT No.: PCT/US95/13211

§ 371 Date: Apr. 14, 1997

§ 102(e) Date: Apr. 14, 1997

[87] PCT Pub. No.: WO96/11857

PCT Pub. Date: Apr. 25, 1996

[30] Foreign Application Priority Data

Oct. 13, 1994 [EP] European Pat. Off. ..... 94870161

[51] Int. Cl.[6] ..... B65D 51/16; B65B 7/00

[52] U.S. Cl. ..... 156/73.5; 156/242; 156/250; 215/261

[58] Field of Search ..... 156/69, 73.5, 242, 156/250; 264/68; 215/261

[56] References Cited

U.S. PATENT DOCUMENTS

| | | | |
|---|---|---|---|
| 3,951,293 | 4/1976 | Schulz | 215/261 |
| 4,136,796 | 1/1979 | Dubois et al. | 220/256 |
| 4,337,104 | 6/1982 | Lynn | 156/69 |
| 4,765,499 | 8/1988 | Von Reis et al. | 215/261 |

FOREIGN PATENT DOCUMENTS

| | | | |
|---|---|---|---|
| 903509 | 2/1989 | Germany | B65D 51/16 |

*Primary Examiner*—James Sells
*Attorney, Agent, or Firm*—Ronald W. Kock

[57] ABSTRACT

The present invention is a venting cap (1) with a hole (4) and a semi-permeable membrane (7). The membrane is fitted in a housing (6) of particular dimensions which is in turn fitted in a protrusion (5) corresponding to the hole in the cap. The present invention further encompasses a process for the manufacture of the cap.

22 Claims, 3 Drawing Sheets

PROCESS FOR MANUFACTURING A VENTING CAP

TECHNICAL FIELD

The present invention relates to the field of packaging for liquid substances which generate gases, more particularly to venting caps.

BACKGROUND

The problem of venting is well known in the art. Indeed, it is well known that certain liquid substances generate gases and that this may lead to the build up of pressure inside a container containing such liquid substances. Such substances are typically hydrogen peroxide or other bleaches as well as carbonated beverages.

Should no precautions be taken to cope with this pressure build up, the container containing the substance may be subjected to severe stress which usually causes bulging or stress cracking. Bulging refers to the deformation of the container, while stress cracking may cause leakage or even bursting. Thus to avoid these phenomena, it is necessary to vent the container, i.e. to provide means whereby the pressure build up inside the container may be relieved. In other words, it is necessary to provide means whereby the gas generated by the liquid substance can escape to the ambient, while leaktightness of the container is maintained.

One means of achieving this is by providing a cap with a hole, and a membrane inserted in the cap, covering the hole. The membrane is permeable to gases but not to liquids.

There are a number of problems associated with the use of semi permeable membranes.

A first problem is that semi permeable membranes are expensive materials. It is therefore an object of the present invention to provide a venting cap which uses as little membrane material as possible. This object implies not only using small membranes, but also providing a process for manufacturing such a cap which drastically reduces the amount of wasted membrane material, i.e. the amount of membrane material not used for manufacturing caps. This process should of course be compatible with high production speeds required by modern industry.

In the art, it is customary to design membranes which are force fitted in the cap receiving the membranes. This is a fairly simple process because it requires no particular arrangement for securing the membrane to the cap. But in that configuration, it is essential that the membrane is as big as the inside dimensions of the cap, whereas this is not required from the standpoint of venting performance. Also, it implies that a new membrane design has to be developed for each and every cap. It is thus also an object of the present invention to provide a venting means which provides maximum flexibility in that it is applicable to a great variety of caps.

Another flexibility required is flexibility in the membrane material. Indeed, there are many different applications which require venting, and each of those different applications may require different membrane materials.

Yet another problem encountered with membranes is that they are typically made out of delicate items, both because of the materials typically used to make them, and because they are typically very thin. Thus they can very easily be damaged during the process of their insertion into the cap. It is thus another object of the present invention to obviate the need for special precautions during said insertion process.

In U.S. Pat. No. 4,765,499, an arrangement is proposed wherein a small membrane is fitted into a liner, the size of which corresponds to the inside diameter of the cap receiving the arrangement. This arrangement does not meet the objects of the present invention because it can only fit caps of a determined dimension, i.e. it does not provide the desired flexibility. Furthermore the arrangement in '499 cannot be obtained by a process meeting all of the above objects. Actually, '499 fails to disclose any suitable process at all.

In AU 9341259, a venting cap is disclosed wherein a small membrane is secured to the inner surface of the cap's top wall by ultrasonic welding. Because ultrasonic welding is an essential requirement for providing the arrangement, drastic limitations are imposed on suitable materials for that arrangement. i.e. one can only use materials which can be ultrasonically welded. The '259 arrangement thus does not provide the desired flexibility either.

SUMMARY OF THE INVENTION

In one embodiment, the present invention encompasses a process for making a venting cap, said process comprising the steps of:

forming a cap comprising a top wall and a depending skirt, said top wall or skirt comprising a substantially tubular protrusion extending therefrom, said cap comprising a hole through the thickness of said top wall or said skirt, said hole corresponding to said protrusion;

forming a housing with a membrane fitted in said housing, the cross sectional outer dimension of said housing being smaller than the cross sectional inner dimension of said skirt;

then fitting said housing with its fitted membrane with said protrusion in said cap.

In a highly preferred execution of this embodiment, the housing with its fitted membrane are made by insert injection molding.

In a second embodiment, the present invention further encompasses a venting cap obtainable by a process according to the preceding claims, said cap comprising a top wall (2) and a depending skirt (3), said top wall or said skirt comprising a substantially tubular protrusion (5) extending therefrom, said cap further comprising a hole (4) through the thickness of said top wall or said skirt, said hole corresponding to said protrusion, said cap further comprising a semi permeable membrane (7), said membrane being fitted in said cap by means of a housing (6) in which said membrane is fitted, said housing being fitted with said protrusion in said cap, the cross sectional outer dimension of said housing being smaller than the cross sectional inner dimension of said skirt.

DETAILED DESCRIPTION OF THE INVENTION

Figure 1:
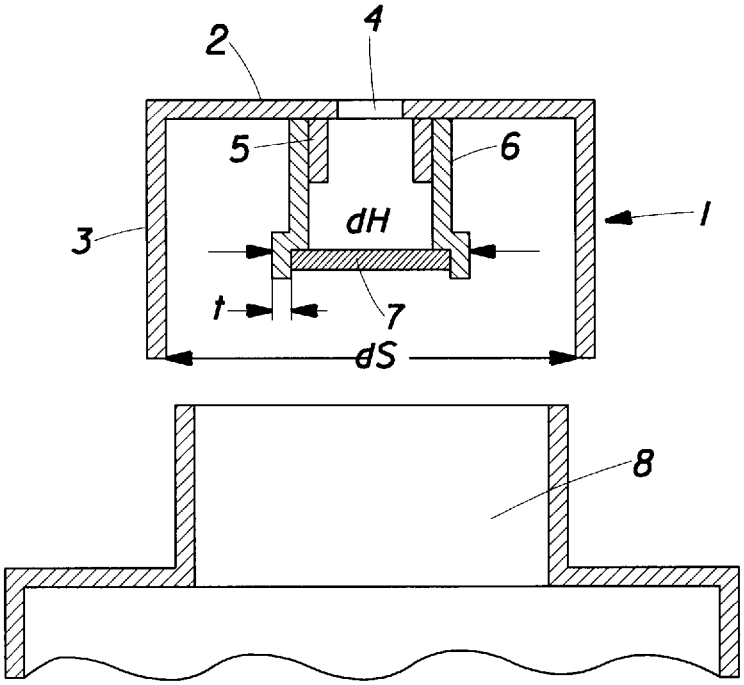
FIGS. 1 and 2 are cross section side views of caps according to the present invention.

The process for making the cap will better be understood after the cap structure is described. Thus in one embodiment, the present invention encompasses a venting cap (1). The cap according to the present invention can be made from a variety of materials, and particularly suitable materials include (thermo)plastic polymers or copolymers, including polyethylene (high and low density), polypropylene, polystyrene, polyester, polyvinylchloride, polycrabonate, nylon, PETG.

The cap (1) comprises a top wall (2) and a depending skirt (3). The cap cooperates with the neck of a container (8) onto which it is to be fixed, e.g. by force fitting, screwing, snapping, etc. The cap comprises a hole (4) through the thickness of the top wall or the skirt, which will allow the gases generated inside the container to escape to the ambient. It is to be understood that there can be one or several holes in the cap.

Figure 2:
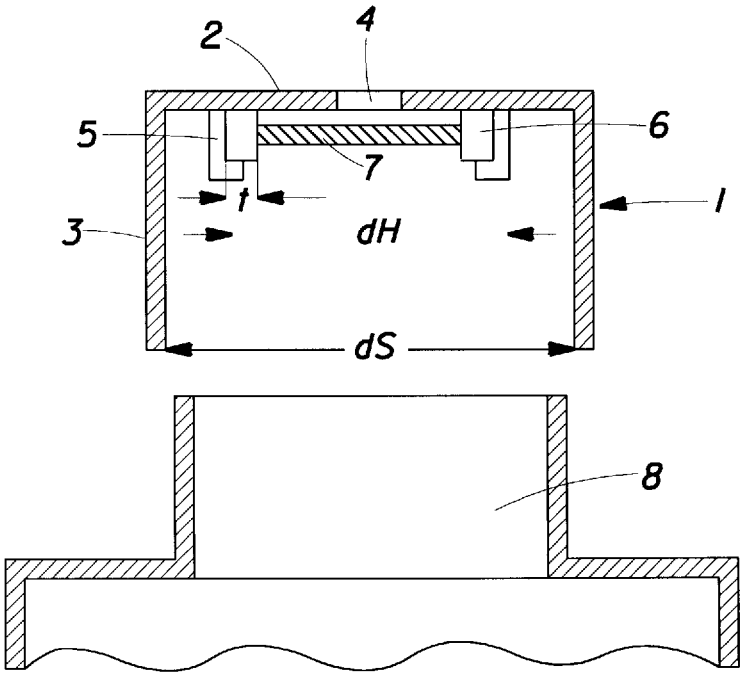

The cap further comprises a substantially tubular protrusion (5) extending from the side wall or the top wall. The protrusion can extend inwards from the inner surface of the top wall or the skirt, i.e. towards the inside of the container, as in FIG. 1, or outwards from that surface, as in FIG. 2. In the latter case, if the thickness of the top wall or skirt is sufficient, the protrusion is provided by the hole, or more precisely by the periphery of the top wall or skirt delimiting the hole. It is essential that the protrusion should correspond to the hole. By "correspond", it is meant herein that the protrusion must surround the hole, so that after the housing (6), described hereinafter, with its membrane is fitted in the protrusion, any contact between the hole and the inside of the container, when the cap is on the container, must be through at least a portion of the membrane (7). As explained in the description, hereinafter, of the process according to the invention, the protrusion may be formed, e.g. molded with the cap, or it may be assembled with the cap after it is formed, e.g. by glueing, spin welding, interference fitting, etc.

The cap further comprises a semi permeable membrane (7). By semi permeable, it is to be understood that the membrane is sufficiently permeable to the gasses generated inside the container, in order to allow these gasses to escape to the ambient, and sufficiently impermeable to the substance contained in the container in order to prevent significant leakage, preferably all leakage. The present invention is not limited to any particular type of membrane material. Suitable materials include polyethylene (high and low density), polypropylene, polyester, nylon, PTFE. The preferred membrane materials for this application are:

- non-woven spunbonded polyethylene film material sold under the tradename, Tyvek, by the Du Pont company, of which Tyvek, Style 10, which is fluorocarbon treated to achieve high fluid impermeability, is the most preferred.
- an acrylic copolymer cast on a non-woven support (nylon or PET) with a fluoro-moner post-treament providing hydrophobicity, sold under the tradename, Versapor, by the Gelman Sciences company, 600, South Wagner Road, Ann Arbor, Mich. 48106, US.

In the cap of the present invention, the membrane is fitted in a housing (6) which is, in turn fitted with the protrusion (5). The following description of a process for making the cap of the invention explains how the membrane (7) is fitted in the housing (6). The housing and the protrusion (5) may further comprise a variety of securing means. Suitable securing means include mating screw threads, as well cooperating ridges and grooves for snapping said housing around or into said protrusion. The housing (6) and the protrusion (7) may also be simply glued together, spin welded, or interference fitted together. Also, the protrusion may be the housing may be arranged together so as to firmly hold the top wall or skirt. For instance, the protrusion may be a tube with a dependent rim at one of its extremitie. This protrusion is then introduced through the hole from either side of the cap, so that the rim rests on the top wall or skirt. The housing is then fitted with the protrusion on the other of said either side.

It is also an essential element of the present invention that the cross sectional outer dimension (dH) of said housing is smaller than the cross sectional inner dimension of said skirt (dS).

Also, suitable housings with fitted membranes are commercially available. Housings whose dimensions are particularly compatible for use in a vented cap are commercially available from GVS, Via Rome 50, 40069, Zola Predosa (bo), Italy.

It can be seen that the cap according to the present invention allows for a great flexibility in the variety of caps into which such housings can be fitted, and also in the design of the housing. Indeed, the connection between the housing and the cap does not rely on the internal dimensions of the skirt, and/or the container's neck, as most prior art arrangements proposed. Only a determined protrusion size is required, and this can be built in existing caps in a straightforward manner. For the same reason that the fitting of the membrane in the cap does not depend any longer on the dimensions of the cap, the present invention allows for the use of smaller membranes. The present invention allows the use of membranes which can be smaller than or as small as the surface of the hole. Preferably, membranes used herein have a surface which is at most from 25% to 50% of the inner surface of the top wall, preferably at most from 5% to 10%

Another preferred feature, for the reasons explained in the process description hereinafter, is that the membrane and the portion of the housing which houses the membrane should be coaxial. Another preferred feature, for the reasons explained hereinafter, is that the thickness (t) of the housing, at least in its region where it houses the membrane, should be as small as possible, preferably of from 3 mm to 10 mm, most preferably of from 1 mm to 3 mm.

A cap according to the present invention can be manufactured by a process which is another embodiment of the present invention. In its broadest definition, the process comprises the three steps of:

- forming a cap comprising a top wall and a depending skirt, said top wall or skirt comprising a substantially tubular protrusion extending therefrom, said cap comprising a hole through the thickness of said top wall or said skirt, said hole corresponding to said protrusion;
- forming a housing with a membrane fitted in said housing, the cross sectional outer dimension of said housing being smaller than the cross sectional inner dimension of said skirt;
- then fitting said housing with its fitted membrane with said protrusion in said cap.

The first and second steps can naturally be performed in any given order while the third step can only be performed after the first two steps.

The first step listed corresponds to the forming of the cap, with its hole and protrusion, without the housing and the membrane. It can be performed by any of the techniques available for this purpose such as injection molding, blow molding, thermoforming, injection blow molding. This step may be completed in a single operation or several operations. For instance a cap may be molded in a first operation, and a hole can be drilled in the top wall in a second operation. The protrusion can be separately manufactured, but it will advantageously be formed together with the cap, e.g. by molding. The final result of this step is a cap with a hole and a corresponding protrusion, ready to receive the housing with its fitted membrane.

Figure 3:
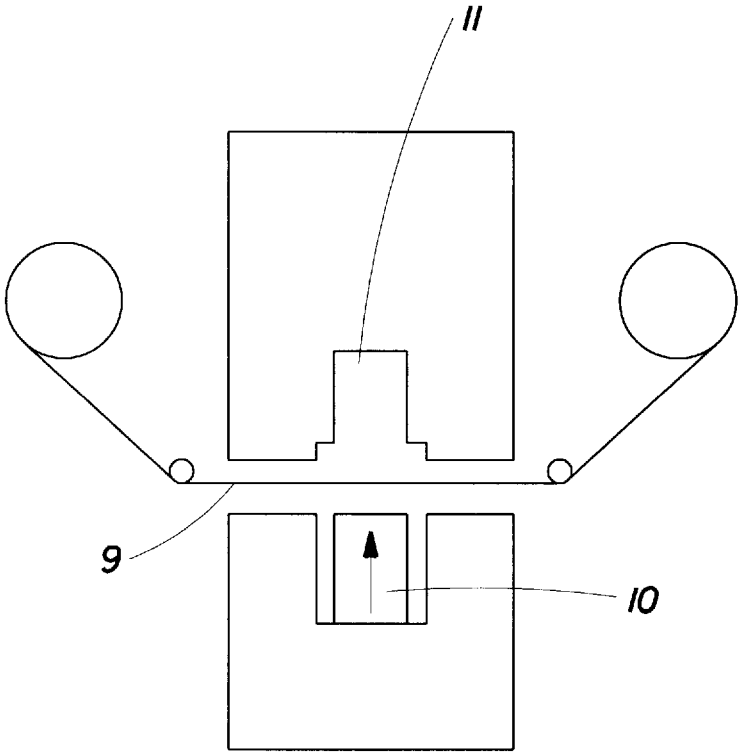
FIG. 3 is a schematic representation of an apparatus suitable for performing the process of the present invention.

The second step listed is the manufacture of the housing and the fitting of the membrane in the housing. In a highly preferred embodiment of the present invention, referring to FIG. 3, this step can be achieved by an "insert molding operation" where:

a sheet (9) of membrane material is fed into an apparatus; the sheet of membrane material is advantageously fed from a roll of membrane material;

in said apparatus, at least one membrane is cut from said sheet and is placed into a mold wherein said housing will be formed. Advantageously, the cutting of the membrane and its placing in the mold can be performed by means of a rod (10) with a sharp circumference which is pushed in the mold (11), the sheet of membrane material being initially placed between the rod and the mold. In this embodiment, the cutting and placing of the membrane in the mold is performed substantially simultaneously. This is particularly advantageous as it avoids the need for an additional manipulation on the fragile membrane material.

then, the housing is molded substantially around said membrane in a manner which secures said membrane in said housing. By "substantially around" it is meant herein that once completed, this step should generate a housing with its fitted membrane, where both surfaces of the membrane are accessible to air, but the membrane is tightly maintained in the housing.

In order to speed up production of housings with fitted membranes, it is advantageous to use an apparatus which comprises a plurality of mold cavities for a plurality of housings, with corresponding rods, operating simultaneously.

Figure 4A:
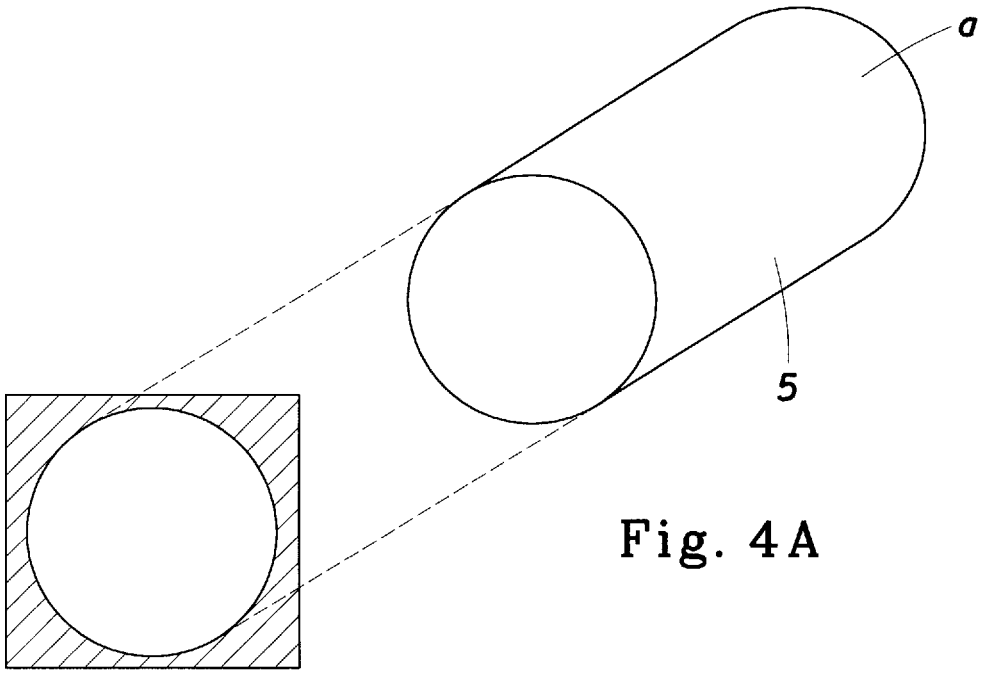
FIGS. 4A and 4B are schematic representation of the preferred embodiment where the housing and the membrane are coaxial.
Figure 4B:
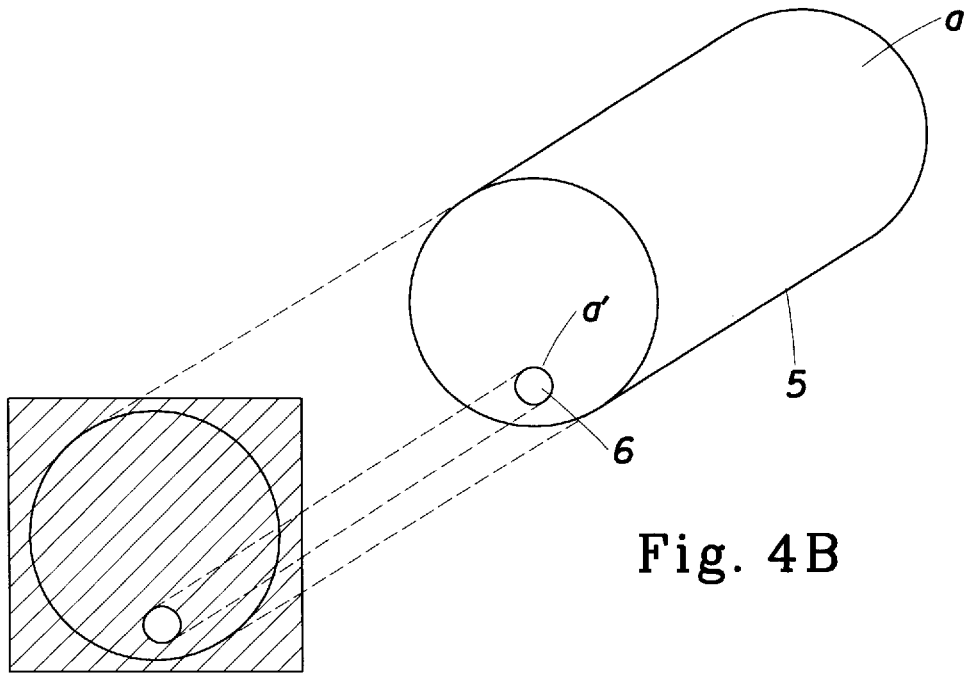

In order to waste as little membrane material as possible, the membrane and the portion of the housing which houses the membrane should be substantially coaxial. Indeed, referring to FIG. 4A, coaxiality (along axis A) of the housing and the membrane creates less unused part of membrane sheet whereas, as in FIG. 4B, if the housing is not coaxial (axis A) with the membrane (axis A'), then a much larger portion of-membrane sheet shown in hatched lines is wasted, and only a small portion of that membrane sheet material is used to make the membrane. For the same reason, it is highly preferred that the thickness (t) of the housing, at least in its region where it houses the membrane, should be as small as possible, because the thickness of the housing corresponds to a portion of the membrane material sheet which is not used to make membranes. Preferably, the thickness of the housing should be less than 5 mm, most preferably less than 1 mm.

In a preferred process herein, the surface of said sheet which is not used to make membranes is less than 80% of the total surface of said sheet, preferably less than 50%, more preferably less than 25%.

This process of fitting membranes into a housing can be performed completely separately from the remainder of the process. Also, suitable housings with fitted membranes are commercially available. Housings whose dimensions are particularly compatible for use in a vented cap are commercially available from GVS, Via Rome 50, 40069, Zola Predosa (bo), Italy.

The third step listed is the assembly of the housing with its fitted membrane produced in the second step, into the cap produced in the first step. There are no particular limitations on this step, which depends essentially on whether the housing and the cap have means for cooperating, and if yes on the nature of these means. Suitable operations in this third step may thus include glueing, interference fitting, spin welding, snap locking, or screwing of the housing in the cap. Interference fitting can be preferred as it is the quickest.

What is claimed is:

1. A process for making a venting cap, said process comprising the steps of:

forming a cap comprising a top wall and a depending skirt, said top wall comprising a substantially tubular protrusion extending therefrom, said cap comprising a hole through the thickness of said top wall, said hole corresponding to said protrusion;

forming a housing with a membrane fitted in said housing, said step of forming said housing comprising the steps of:

feeding a sheet of membrane material into an apparatus;

cutting said membrane from said sheet;

placing said cut membrane into a mold;

forming the housing from said mold substantially around said cut membrane in a manner which secures said cut membrane in said housing;

then fitting said housing with its cut membrane with said protrusion in said cap.

2. A process according to claim 1, wherein said step of cutting said membrane and said step of placing said cut membrane into said mold are substantially simultaneous.

3. A process according to claim 1, wherein said process comprises a plurality of mold cavities for a plurality of housings operating simultaneously.

4. A process according to claim 1, wherein the surface of said sheet which is not used to make membranes is less than about 50% of the total surface of said sheet.

5. A process according to claim 4, wherein the surface of said sheet which is not used to make membranes is less than about 25% of the total surface of said sheet.

6. A process according to claim 1, wherein said surface of the membrane is at most from about 25% to 50% of the inner surface of the top wall.

7. A process according to claim 1, wherein said surface of the membrane is at most from about 5% to 10% of the inner surface of the top wall.

8. A venting cap, said cap comprising a top wall (2) and a depending skirt (3), said top wall comprising a substantially tubular protrusion (5) extending therefrom, said cap further comprising a hole (4) through the thickness of said top wall, said hole corresponding to said protrusion, said cap further comprising a semi permeable membrane (7), said membrane having a surface area which less than about 50% of the inner surface area of the top wall, wherein said membrane is fitted in said cap by means of a housing (6), said housing being fitted with said protrusion in said cap.

9. A cap according to claim 8 wherein said membrane and the portion of said housing which houses said membrane are substantially coaxial.

10. A cap according to claim 8 wherein the thickness (t) of the housing, at least in its region where it houses the membrane, is of from 3 mm to 10 mm.

11. A cap according to claim 8 wherein said protrusion and said housing comprise securing means.

12. A cap according to 11 wherein said securing means comprise mating screw threads.

13. A cap according to claim 11 wherein said securing means comprise cooperating ridges and grooves for snapping said housing around or into said protrusion.

14. A cap according to claim 11 wherein said securing means comprise interference fitting said housing around or into said protrusion.

15. A cap according to claim 8 wherein said housing and said protrusion are glued together.

16. A cap according to claim 8 wherein said housing and said protrusion are spun welded together.

17. A cap according to claim 10, wherein said thickness is from about 1 mm to about 3 mm.

18. A container, said container comprising:

(a) a venting cap, said cap comprising a top wall (2) and a depending skirt (3), said top wall comprising a substantially tubular protrusion (5) extending therefrom, said cap further comprising a hole (4) through the thickness of said top wall, said hole corresponding to said protrusion, said cap further comprising a semi permeable membrane (7), said membrane having a surface which less than about 50% of the inner surface of the top wall, wherein said membrane is fitted in said cap by means of a housing (6) in which said membrane is fitted, said housing being fitted with said protrusion in said cap;

(b) a container with a finish, wherein said skirt engages said finish and said housing is spaced inwardly from said finish.

19. A container according to claim 18, wherein said protrusion depends from said top wall and is spaced inwardly from said skirt.

20. A container according to claim 19, wherein said housing is fitted with said protrusion and is spaced inwardly from said skirt.

21. A cap according to claim 8, wherein said surface of the membrane is at most from about 25% to 50% of the inner surface of the top wall.

22. A cap according to claim 8, wherein said surface of the membrane is at most from about 5% to 10% of the inner surface of the top wall.

* * * * *